US012631004B2

(12) United States Patent
Hokari et al.

(10) Patent No.: US 12,631,004 B2
(45) Date of Patent: May 19, 2026

(54) WORK MACHINE START-UP SYSTEM AND WORK MACHINE START-UP METHOD

(71) Applicant: Komatsu Ltd., Tokyo (JP)

(72) Inventors: Tomofumi Hokari, Tokyo (JP); Yuichiro Yasuda, Tokyo (JP); Kenji Nozaki, Tokyo (JP); Kosuke Iwata, Tokyo (JP)

(73) Assignee: KOMATSU LTD., Tokyo (JP)

( * ) Notice: Subject to any disclaimer, the term of this patent is extended or adjusted under 35 U.S.C. 154(b) by 181 days.

(21) Appl. No.: 18/278,249

(22) PCT Filed: Mar. 24, 2022

(86) PCT No.: PCT/JP2022/014185
§ 371 (c)(1),
(2) Date: Aug. 22, 2023

(87) PCT Pub. No.: WO2022/210309
PCT Pub. Date: Oct. 6, 2022

(65) Prior Publication Data

US 2024/0125090 A1 Apr. 18, 2024

(30) Foreign Application Priority Data

Mar. 31, 2021 (JP) ..... 2021-061479

(51) Int. Cl.
*E02F 9/20* (2006.01)

(52) U.S. Cl.
CPC ..... *E02F 9/2025* (2013.01)

(58) Field of Classification Search
CPC ..... E02F 3/435; E02F 9/2025; E02F 9/2066
See application file for complete search history.

(56) References Cited

U.S. PATENT DOCUMENTS

| | | | | |
|---|---|---|---|---|
| 9,975,522 | B2 * | 5/2018 | Nakamura | E02F 9/2062 |
| 10,132,259 | B1 * | 11/2018 | Watson | F02N 11/101 |
| 12,227,145 | B2 * | 2/2025 | Maley | E02F 9/24 |
| 2013/0006482 | A1 * | 1/2013 | Hukkeri | G01C 7/04 73/146 |
| 2013/0167227 | A1 | 6/2013 | Miura et al. | |
| 2015/0301518 | A1 | 10/2015 | Takemoto et al. | |
| 2017/0058489 | A1 * | 3/2017 | Nomura | B60R 25/20 |
| 2017/0282857 | A1 * | 10/2017 | Nakamura | E02F 9/265 |
| 2018/0334136 | A1 * | 11/2018 | Chaston | G06V 20/56 |
| 2018/0334979 | A1 * | 11/2018 | Watson | F02N 11/0807 |
| 2022/0127820 | A1 | 4/2022 | Yokota et al. | |

FOREIGN PATENT DOCUMENTS

| | | | |
|---|---|---|---|
| EP | 3708441 | A1 | 9/2020 |
| JP | 2002331912 | A | 11/2002 |
| JP | 2013066424 | A | 4/2013 |

(Continued)

*Primary Examiner* — Tyler J Lee
(74) *Attorney, Agent, or Firm* — Troutman Pepper Locke LLP

(57) ABSTRACT

A work machine start-up system includes a control unit configured to control a work machine, a proximity detection unit configured to detect that a specific operator is in close proximity to the work machine, and a start-up unit configured to start at least part of the control unit when it is detected that the specific operator is in close proximity to the work machine.

16 Claims, 9 Drawing Sheets

(56) References Cited

FOREIGN PATENT DOCUMENTS

| | | | |
|---|---|---|---|
| JP | 2014-205469 | A | 10/2014 |
| JP | 2015-124514 | A | 7/2015 |
| JP | 2016-196759 | A | 11/2016 |
| JP | 2017-024718 | A | 2/2017 |
| JP | 2018079883 | A | 5/2018 |
| JP | 2018-114978 | A | 7/2018 |
| JP | 2020004152 | A | 1/2020 |
| JP | 2020-153110 | A | 9/2020 |
| JP | 2020-158997 | A | 10/2020 |

* cited by examiner

WORK MACHINE START-UP SYSTEM AND WORK MACHINE START-UP METHOD

TECHNICAL FIELD

The present disclosure relates to a work machine start-up system and a work machine start-up method.

Priority is claimed on Japanese Patent Application No. 2021-061479, filed Mar. 31, 2021, the content of which is incorporated herein by reference.

BACKGROUND ART

In the field of work machines, there is known a technique in which the presence of an operator is determined by a keyless entry system using a wireless signal to enable unlocking of a door. For example, Patent Document 1 discloses a technique related to a keyless entry system.

CITATION LIST

[Patent Document]

[Patent Document 1]

Japanese Unexamined Patent Application, First Publication No. 2014-205469

SUMMARY OF INVENTION

Technical Problem

On the other hand, since a control unit to control a work machine is started by an operation of an ignition key or the like after an operator boards the work machine, it may take some time before the work machine can be operated.

An object of the present disclosure is to provide a work machine start-up system and a work machine start-up method, which can enable a work machine to be operated at an early stage.

Solution to Problem

According to one aspect, a work machine start-up system includes a control unit configured to control a work machine, a proximity detection unit configured to detect that a specific operator is in close proximity to the work machine, and a start-up unit configured to start at least part of the control unit when it is detected that the specific operator is in close proximity to the work machine.

Advantageous Effects of Invention

According to the above aspect, the work machine start-up system can enable the work machine to be operated at an early stage.

DESCRIPTION OF EMBODIMENTS

First Embodiment

Hereinafter, an embodiment of the present invention is described in detail with reference to the drawings.

«Configuration of Work Machine 100»

Figure 1:
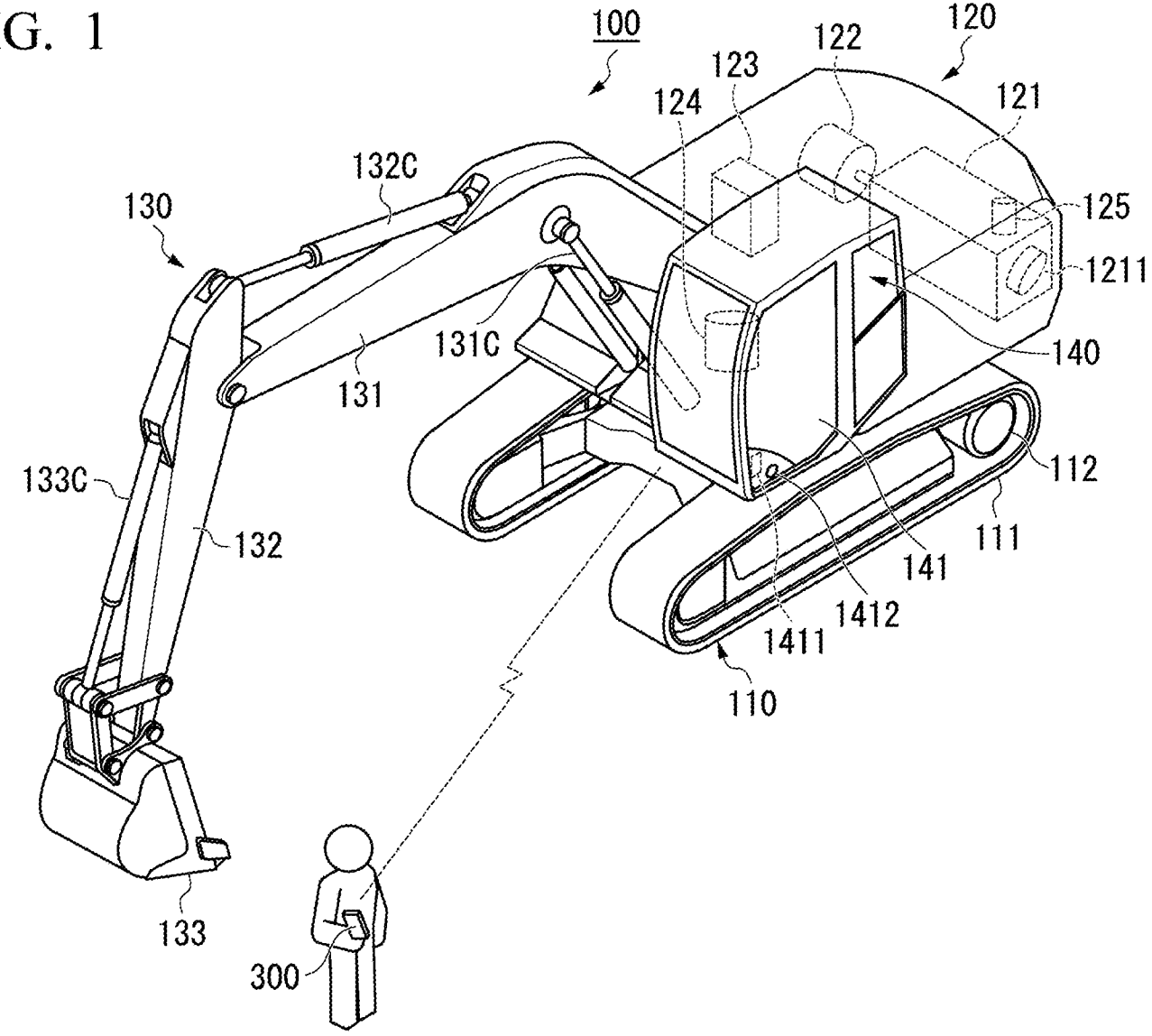
FIG. 1 is a schematic diagram showing a configuration of a work machine according to a first embodiment.

FIG. 1 is a schematic diagram showing a configuration of a work machine 100 according to a first embodiment.

The work machine 100 operates at a construction site and constructs a construction target such as earth. The work machine 100 according to the first embodiment is, for example, a hydraulic excavator. The work machine 100 includes an undercarriage 110, a swing body 120, work equipment 130, and a cab 140. The work machine 100 according to the first embodiment performs authentication of an operator by performing communication with an operator terminal 300 such as a smartphone owned by the operator by Bluetooth low energy (BLE) (Bluetooth is a registered trademark). Incidentally, in another embodiment, the work machine 100 and the operator terminal 300 may perform communication by a short-range wireless communication method other than BLE, such as Bluetooth (registered trademark) and Zigbee (registered trademark).

The undercarriage 110 supports travel of the work machine 100. The undercarriage 110 includes two endless tracks 111 provided on the left and right and two traveling motors 112 for driving each endless track 111.

The swing body 120 is supported by the undercarriage 110 to be swingable around a swing center.

The work equipment 130 is driven by hydraulic pressure. The work equipment 130 is supported by a front portion of the swing body 120 to be driveable in an up to down direction. The cab 140 is a space in which an operator boards and operates the work machine 100. The cab 140 is provided on a left front portion of the swing body 120.

Here, a portion of the swing body 120 to which the work equipment 130 is attached is referred to as a front portion. In addition, in the swing body 120, a portion on an opposite side, a portion on a left side, and a portion on a right side with respect to the front portion are referred to as a rear portion, a left portion, and a right portion.

«Configuration of Swing Body 120»

The swing body 120 includes an engine 121, a hydraulic pump 122, a control valve 123, a swing motor 124, and a fuel injection device 125.

The engine 121 is a prime mover that drives the hydraulic pump 122. The engine 121 is an example of a power source. A cell motor 1211 is provided in the engine 121. The engine 121 is started by the rotation of the cell motor 1211.

The hydraulic pump 122 is a variable capacity pump driven by the engine 121. The hydraulic pump 122 supplies hydraulic oil to each actuator (a boom cylinder 131C, an arm cylinder 132C, a bucket cylinder 133C, the traveling motor 112, and the swing motor 124) via the control valve 123.

The control valve 123 controls a flow rate of the hydraulic oil supplied from the hydraulic pump 122.

The swing motor 124 is driven by the hydraulic oil supplied from the hydraulic pump 122 via the control valve 123 to swing the swing body 120.

The fuel injection device 125 injects fuel into the engine 121.

«Configuration of Work Equipment 130»

The work equipment 130 includes a boom 131, an arm 132, a bucket 133, the boom cylinder 131C, the arm cylinder 132C, and the bucket cylinder 133C.

A proximal end portion of the boom 131 is attached to the swing body 120 via a boom pin.

The arm 132 connects the boom 131 and the bucket 133. A proximal end portion of the arm 132 is attached to a distal end portion of the boom 131 via an arm pin.

The bucket 133 includes blades that excavate earth or the like, and an accommodating portion that accommodates the excavated earth. A proximal end portion of the bucket 133 is attached to a distal end portion of the arm 132 via a bucket pin.

The boom cylinder 131C is a hydraulic cylinder to operate the boom 131. A proximal end portion of the boom cylinder 131C is attached to the swing body 120. A distal end portion of the boom cylinder 131C is attached to the boom 131.

The arm cylinder 132C is a hydraulic cylinder to drive the arm 132. A proximal end portion of the arm cylinder 132C is attached to the boom 131. A distal end portion of the arm cylinder 132C is attached to the arm 132.

The bucket cylinder 133C is a hydraulic cylinder to drive the bucket 133. A proximal end portion of the bucket cylinder 133C is attached to the arm 132. A distal end portion of the bucket cylinder 133C is attached to a link member connected to the bucket 133.

«Configuration of Cab 140»

On the left surface of the cab 140, a door 141 is provided for an operator to board. The door 141 is provided with a lock actuator 1411 to lock the door 141 and a door switch 1412 to release the lock.

Figure 2:
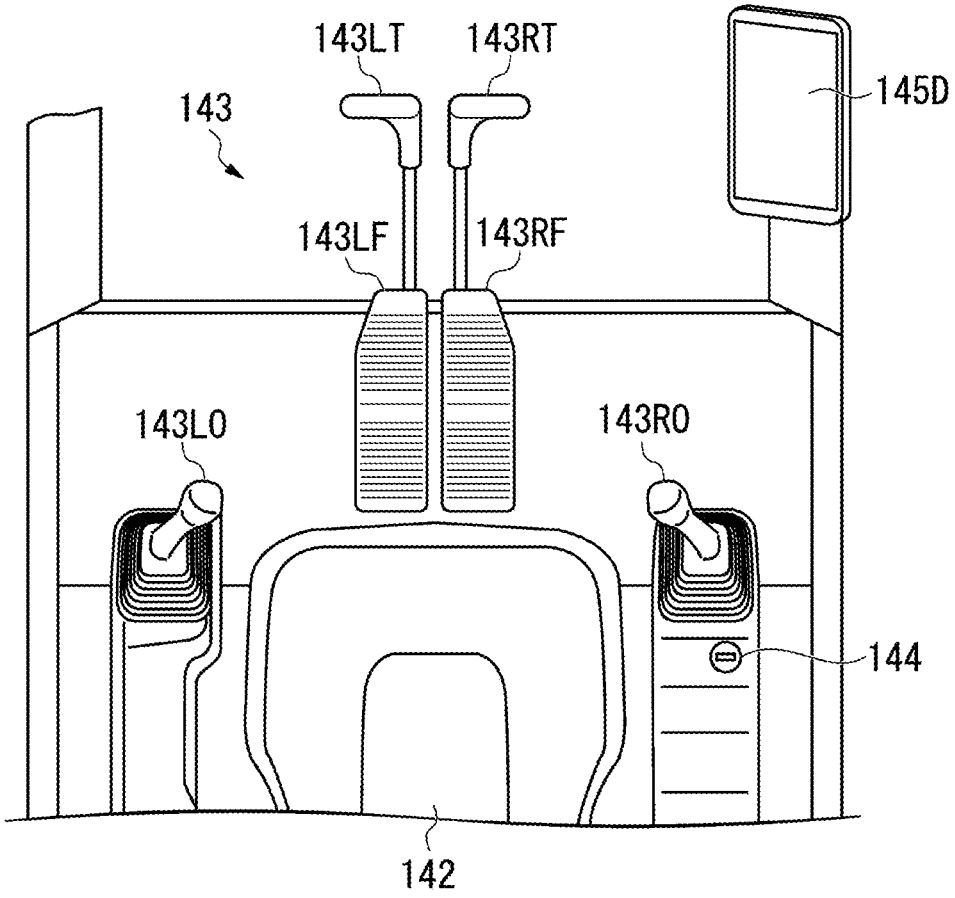
FIG. 2 is a view showing an internal configuration of a cab according to the first embodiment.

FIG. 2 is a diagram showing an internal configuration of the cab 140 according to the first embodiment.

In the cab 140, a driver seat 142, an operation device 143, a rotary switch 144, and a touch panel 145D are provided. The rotary switch 144 is a switch that takes four positions of OFF, ACC (accessory), IG (ignition), and ST (start) when rotated.

Incidentally, when a finger is released from the rotary switch 144 at the ST position, the rotary switch 144 automatically returns to the IG position by a spring mechanism (not shown).

The operation device 143 is a device to drive the undercarriage 110, the swing body 120, and the work equipment 130 by a manual operation of the operator. The operation device 143 includes a left operation lever 143LO, a right operation lever 143RO, a left foot pedal 143LF, a right foot pedal 143RF, a left traveling lever 143LT, and a right traveling lever 143RT.

The left operation lever 143LO is provided on a left side of the driver seat 142. The right operation lever 143RO is provided on a right side of the driver seat 142.

The left operation lever 143LO is an operation mechanism to cause the swing body 120 to perform a swing operation and to cause the arm 132 to perform an excavating or dumping operation. Specifically, when the operator of the work machine 100 tilts the left operation lever 143LO forward, the arm 132 performs a dumping operation. In addition, when the operator of the work machine 100 tilts the left operation lever 143LO backward, the arm 132 performs an excavating operation. In addition, when the operator of the work machine 100 tilts the left operation lever 143LO in a right direction, the swing body 120 swings rightward. In addition, when the operator of the work machine 100 tilts the left operation lever 143LO in a left direction, the swing body 120 swings leftward. Incidentally, in another embodiment, when the left operation lever 143LO is tilted in a front to back direction, the swing body 120 may swing rightward or swing leftward, and when the left operation lever 143LO is tilted in a right to left direction, the arm 132 may perform an excavating operation or a dumping operation.

The right operation lever 143RO is an operation mechanism to cause the bucket 133 to perform an excavating or dumping operation and to cause the boom 131 to perform a rising or lowering operation. Specifically, when the operator of the work machine 100 tilts the right operation lever 143RO forward, a lowering operation of the boom 131 is executed. In addition, when the operator of the work machine 100 tilts the right operation lever 143RO backward, a rising operation of the boom 131 is executed. In addition, when the operator of the work machine 100 tilts the right operation lever 143RO in the right direction, a dumping operation of the bucket 133 is performed. In addition, when the operator of the work machine 100 tilts the right operation lever 143RO in the left direction, an excavating operation of the bucket 133 is performed. Incidentally, in another embodiment, when the right operation lever 143RO is tilted in the front to back direction, the bucket 133 may perform a dumping operation or an excavating operation, and when the right operation lever 143RO is tilted in the right to left direction, the boom 131 may perform a rising operation or a lowering operation.

The left foot pedal 143LF is disposed on a left side of a floor surface in front of the driver seat 142. The right foot pedal 143RF is disposed on a right side of the floor surface in front of the driver seat 142. The left traveling lever 143LT is pivotally supported by the left foot pedal 143LF and is configured such that the inclination of the left traveling lever 143LT and the pressing down of the left foot pedal 143LF are linked to each other. The right traveling lever 143RT is pivotally supported by the right foot pedal 143RF and is configured such that the inclination of the right traveling lever 143RT and the pressing down of the right foot pedal 143RF are linked to each other.

The left foot pedal 143LF and the left traveling lever 143LT correspond to rotational drive of a left crawler belt of the undercarriage 110. Specifically, when the operator of the work machine 100 tilts the left foot pedal 143LF or the left traveling lever 143LT forward, the left crawler belt rotates in a forward movement direction. In addition, when the operator of the work machine 100 tilts the left foot pedal 143LF or the left traveling lever 143LT backward, the left crawler belt rotates in a backward movement direction.

The right foot pedal 143RF and the right traveling lever 143RT correspond to rotational drive of a right crawler belt of the undercarriage 110. Specifically, when the operator of the work machine 100 tilts the right foot pedal 143RF or the right traveling lever 143RT forward, the right crawler belt rotates in the forward movement direction. In addition, when the operator of the work machine 100 tilts the right foot pedal 143RF or the right traveling lever 143RT backward, the right crawler belt rotates in the backward movement direction.

<Configuration of Control System 145>

Figure 3:
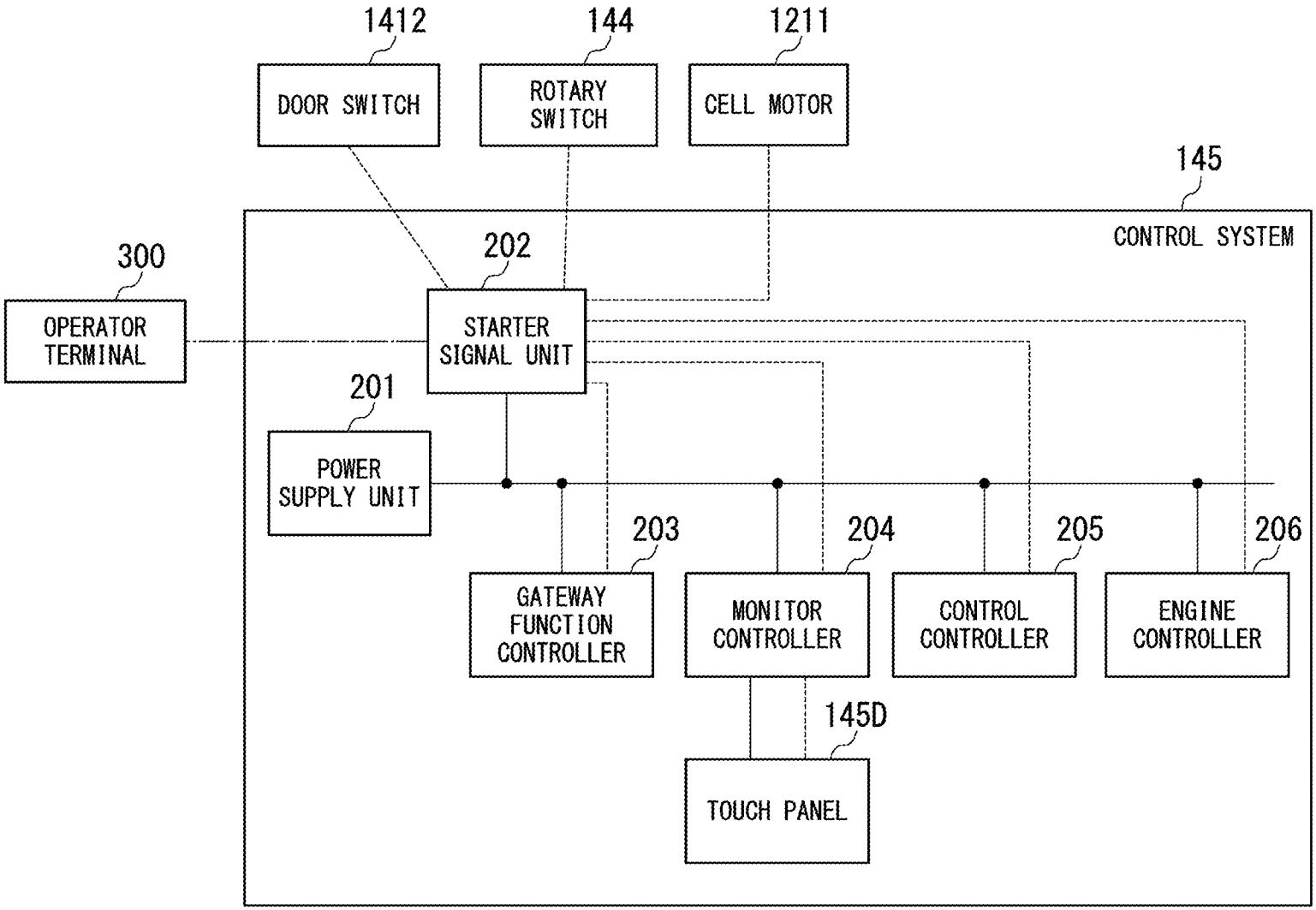
FIG. 3 is a schematic block diagram showing a hardware configuration of a control system according to the first embodiment.

FIG. 3 is a schematic block diagram showing a hardware configuration of a control system 145 according to the first embodiment. In FIG. 3, the solid line represents a power line, and the dashed line represents a signal line. In addition, in FIG. 3, a dot-dashed line represents wireless communication.

The control system 145 includes a power supply portion 201, a starter signal unit 202, a gateway function controller 203, a monitor controller 204, a control controller 205, and an engine controller 206. The starter signal unit 202, the gateway function controller 203, the monitor controller 204, the control controller 205, and the engine controller 206 are connected to each other via in-vehicle network such as controller area network (CAN) or Ethernet (registered trademark). The gateway function controller 203, the monitor controller 204, the control controller 205, and the engine controller 206 constitute a control unit that controls the work machine 100.

The power supply portion 201 supplies electric energy to each device constituting the control system 145.

The starter signal unit 202 receives signal inputs from the door switch 1412, the rotary switch 144, the operator terminal 300, and the monitor controller 204. The starter signal unit 202 outputs a start-up signal to the gateway function controller 203, the monitor controller 204, the control controller 205, the engine controller 206, the lock actuator 1411, or the cell motor 1211 based on the inputted signal. The controller to which the start-up signal is inputted is started and operated by the electric energy supplied by the power supply portion 201. Incidentally, the starter signal unit 202 always operates by receiving the electric energy supplied from the power supply portion 201 even when other controllers are in a stopped state. On the other hand, the starter signal unit 202 may be configured such that, when the work machine 100 is not started, only a BLE communication unit 221 to be described later may be put into a start-up state and other configurations may be in a dormant state or may be started intermittently.

The gateway function controller 203 relays communication between controllers such as the starter signal unit 202, the monitor controller 204, the control controller 205, and the engine controller 206. The gateway function controller 203 is an example of a second control unit that controls communication.

The monitor controller 204 controls the display on the touch panel 145D included in the control system 145 and notifies the occurrence of the touch operation of the touch panel 145D. Incidentally, the control system 145 according to another embodiment may include a monitor such as a liquid crystal display (LCD) and a physical button that do not have a touch input function, instead of the touch panel 145D. In this case, the monitor controller 204 controls the display on the monitor and performs a notification of the pressing of the physical button.

The control controller 205 acquires various data related to a hydraulic device that controls the operation of the work equipment 130 by a sensor (not shown) and outputs a control signal to control the hydraulic device according to the operation of the operation device 143. That is, the control controller 205 controls the drive of the boom cylinder 131C, the arm cylinder 132C, the bucket cylinder 133C, the traveling motor 112, the swing motor 124, or the like. The control controller 205 is an example of a first control unit that outputs a control signal to drive the vehicle body of the work machine 100 with the power supplied by the power source.

The engine controller 206 controls the engine 121 by acquiring various data related to the engine 121 through a sensor (not shown) and instructing the fuel injection device 125 of a fuel injection amount.

There is a difference in a start-up time of each controller. In each controller, the gateway function controller 203 may have the longer start-up time than other controllers such as the starter signal unit 202, the monitor controller 204, the control controller 205, and the engine controller 206.

The control system 145 has a function of performing an authentication processing of an operator boarding the cab 140 by operating the touch panel 145D. For example, the control system 145 may include a controller that performs authentication processing, or the starter signal unit 202, the gateway function controller 203, and the monitor controller 204 may have a function of performing authentication processing. Specifically, the control system 145 displays an operator ID selection screen on the touch panel 145D via the monitor controller 204, and receives the selection of an operator ID. When the selected operator ID indicates an operator having an operation right in close proximity to the work machine 100, the control system 145 authenticates that the operator boarding the cab 140 is the operator having the operation right. The monitor controller 204 is an example of an authentication portion that authenticates the operator of the work machine 100.

Figure 4:
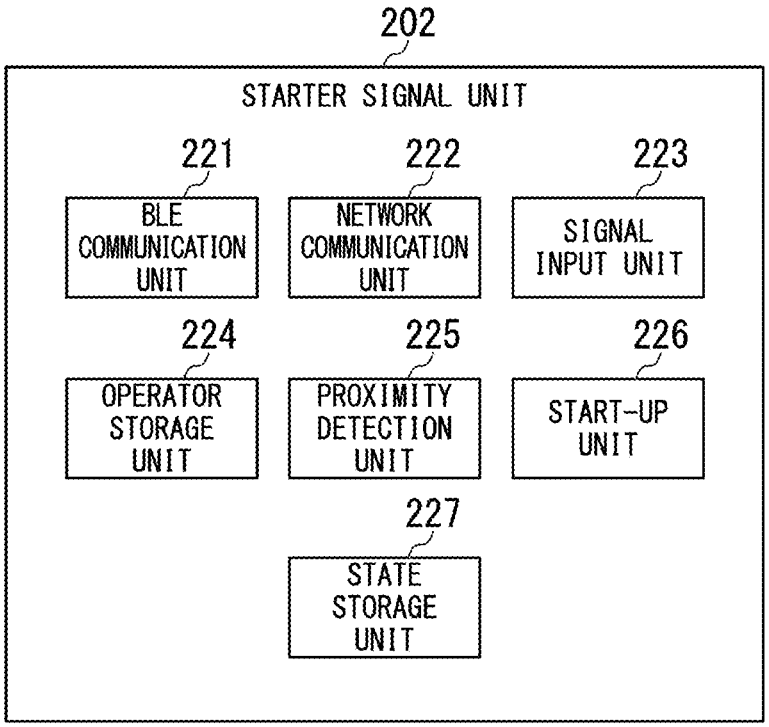
FIG. 4 is a schematic block diagram showing a software configuration of a starter signal unit according to the first embodiment.

FIG. 4 is a schematic block diagram showing a software configuration of the starter signal unit 202 according to the first embodiment.

The starter signal unit 202 includes the BLE communication unit 221, a network communication unit 222, a signal input unit 223, an operator storage unit 224, a proximity detection unit 225, a start-up unit 226, and a state storage unit 227.

The BLE communication unit 221 operates as the central of the BLE and performs communication with the operator terminal 300. The BLE communication unit 221 searches for the communicable operator terminal 300 and receives an advertising packet from the discovered operator terminal 300. The advertising packet includes an operator ID that identifies an operator and a machine ID that indicates the work machine 100 to be started. The operator ID may be, for example, a Bluetooth (registered trademark) device address of the operator terminal 300.

The network communication unit 222 performs communication with other controllers via the in-vehicle network.

The signal input unit 223 receives signals inputted from the door switch 1412 and the rotary switch 144.

The operator storage unit 224 stores an operator ID, a display name, and a right flag indicating whether or not the operation right for the work machine 100 is included, for each operator. A value of the right flag with ON indicates that the operation right for the work machine 100 is included, and a value of the right flag with OFF indicates that the operation right for the work machine 100 is not included. Hereinafter, an operator having the value of the right flag with ON, that is, an operator who has the operation right for the work machine 100 is also referred to as a specific operator.

The proximity detection unit 225 determines whether or not the specific operator is present in the vicinity of the work machine 100, based on the advertising packet received by the BLE communication unit 221 and the information stored in the operator storage unit 224. That is, the proximity detection unit 225 detects that the specific operator is in close proximity to the work machine 100. Specifically, the proximity detection unit 225 specifies the operator ID included in the advertising packet received by the BLE communication unit 221 and determines that the specific operator is in close proximity to the work machine 100 when the right flag associated with the operator ID specified in the operator storage unit 224 is ON. The proximity detection unit 225 records the operator ID of the specific operator in close proximity, to the state storage unit 227 as the proximity state of the specific operator.

The start-up unit 226 outputs a start-up signal to the gateway function controller 203, the monitor controller 204, the control controller 205, the engine controller 206, the lock actuator 1411, or the cell motor 1211.

«Operator Terminal 300»

The operator terminal 300 functions as a peripheral of BLE by executing a start-up program of the work machine 100 installed in advance. When the start-up program is executed, the operator terminal 300 displays a list of the work machines 100 and receives a selection of the work machine 100 to be started from the operator. When the selection of the work machine 100 is received, the operator terminal 300 starts transmission of an advertising packet including the operator ID and the machine ID of the selected work machine 100.

«Operation of Control System 145»

Figure 5:
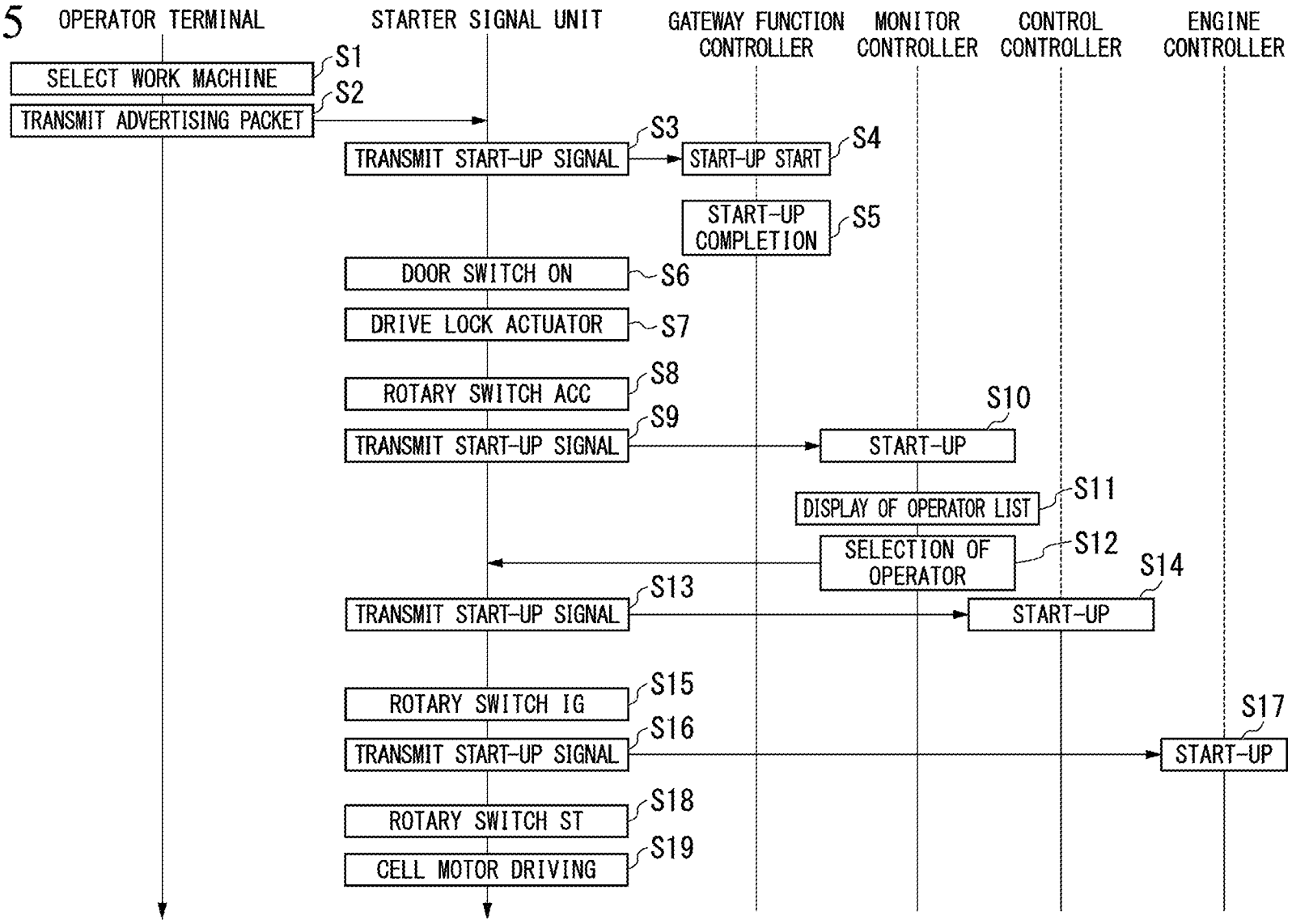
FIG. 5 is a sequence diagram showing an example of a start-up operation of the work machine by the control system in the first embodiment.

Here, a start-up operation of the work machine 100 when an operator (specific operator) who has the operation right for the work machine 100 boards the work machine 100 will be described. The control system 145 is an example of a start-up system for the work machine 100. FIG. 5 is a sequence diagram showing an example of a start-up operation of the work machine 100 by the control system 145 in the first embodiment.

When an operator operates the operator terminal 300 and executes the start-up program, a list of the work machines 100 is displayed, and a selection of the work machine 100 to be started from the operator is received (step S1). When the selection of the work machine 100 is received, the operator terminal 300 transmits an advertising packet including the operator ID and the machine ID of the selected work machine 100 (step S2).

When the starter signal unit 202 receives the advertising packet and determines that the specific operator is in close proximity, the starter signal unit 202 transmits a start-up signal to the gateway function controller 203 (step S3). As a result, the gateway function controller 203 starts start-up (step S4). Thereafter, the gateway function controller 203 completes the start-up (step S5). Incidentally, when the advertising packet reaches the work machine 100 at the beginning, the operator terminal 300 and the work machine 100 are separated by the communicable distance of the BLE. Therefore, when the time required to start the gateway function controller 203 is shorter than the time required for the operator to reach the work machine 100, the start-up of the gateway function controller 203 can be completed by the time the operator reaches the work machine 100 (step S5).

When the operator reaches the work machine 100, the operator presses the door switch 1412 to open the door 141. As a result, the starter signal unit 202 receives a signal indicating ON from the door switch 1412 (step S6). After the proximity state of the specific operator is confirmed, the starter signal unit 202 drives the lock actuator 1411 and releases the lock of the door 141 (step S7).

When the operator enters the cab 140 and puts the rotary switch 144 into the ACC position, the starter signal unit 202 receives a signal indicating ACC from the rotary switch 144 (step S8). After the proximity state of the specific operator is confirmed, the starter signal unit 202 transmits a start-up signal to the monitor controller 204 (step S9). As a result, the monitor controller 204 is started (step S10).

The monitor controller 204 outputs a signal to display the list screen of the operators to the touch panel 145D (step S11). As a result, the list screen of the operators is displayed on the touch panel 145D. The monitor controller 204 receives the selection of one operator ID from the list screen of the operators by an operation of the operator (step S12). The starter signal unit 202 confirms that the selected operator ID indicates the specific operator and transmits a start-up signal to the control controller 205 (step S13). As a result, the control controller 205 is started (step S14).

When the operator puts the rotary switch 144 into the IG position, the starter signal unit 202 receives a signal indicating IG from the rotary switch 144 (step S15). The starter signal unit 202 transmits a start-up signal to the engine controller 206 (step S16). As a result, the engine controller 206 is started (step S17).

When the operator puts the rotary switch 144 into the ST position, the starter signal unit 202 receives a signal indicating ST from the rotary switch 144 (step S18). The starter signal unit 202 drives the cell motor 1211 (step S19). As a result, the engine 121 is started, and the work machine 100 is in an operable state.

As described above, the control system 145 starts the gateway function controller 203 when the specific operator is in close proximity, and then starts the control controller 205 after the specific operator is authenticated. Since the operator needs to enter the cab 140 in order to perform authentication of the operator, the gateway function controller 203 is started before the control controller 205 is started. As a result, the control system 145 can ensure the security of the work machine 100 by starting a device that does not control the vehicle body of the work machine 100, such as the gateway function controller 203 at a time when the specific operator is in close proximity. In addition, since the gateway function controller 203 takes a longer time to start than other devices, the waiting time for the operation of the work machine 100 can be shortened by starting the gateway function controller 203 on condition of the proximity of the specific operator.

The operation of the starter signal unit 202 will be described below.

Figure 6:
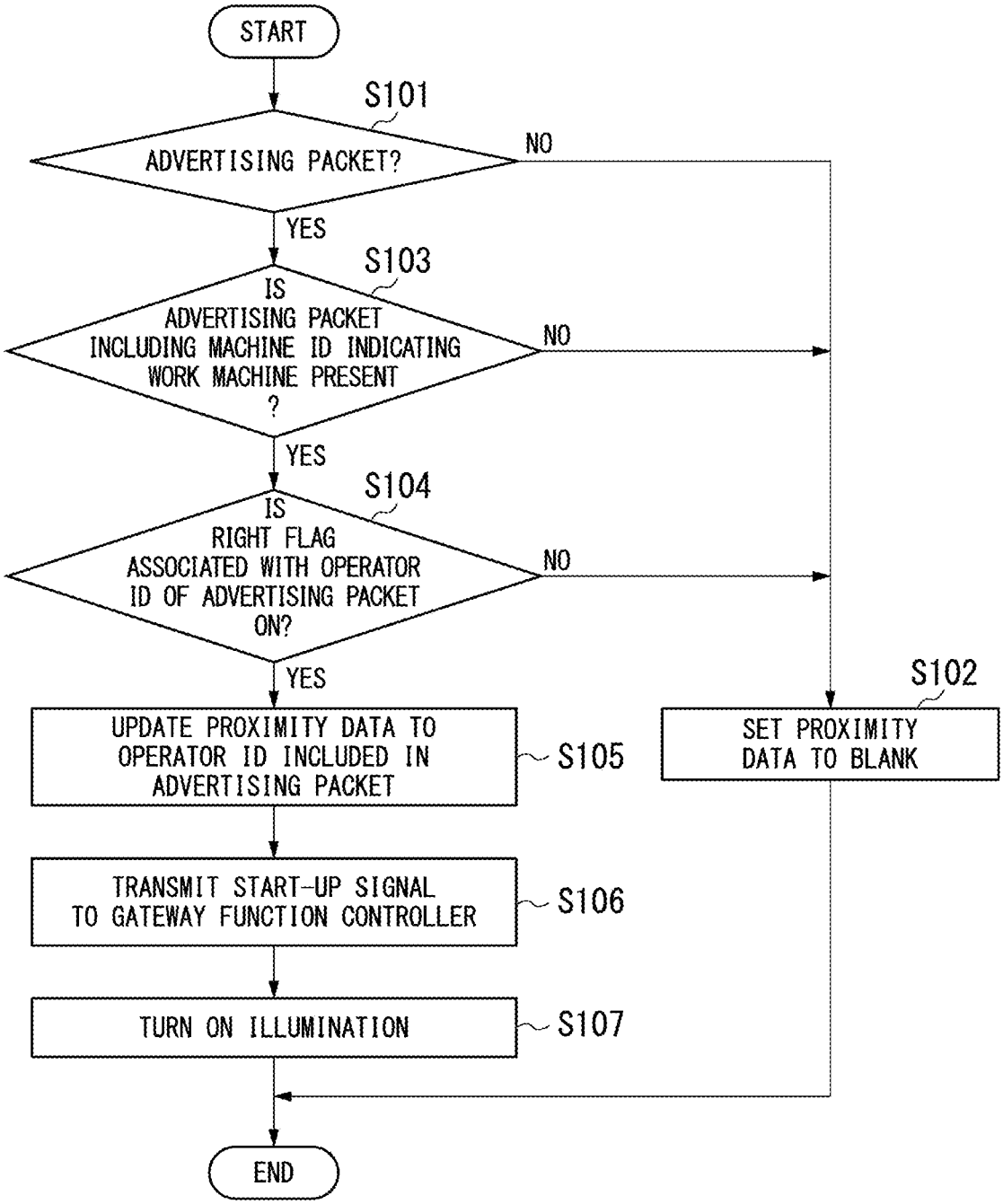
FIG. 6 is a flowchart showing communication processing with an operator terminal by the control system according to the first embodiment.

FIG. 6 is a flowchart showing communication processing with the operator terminal 300 by the control system 145 according to the first embodiment.

The BLE communication unit 221 of the starter signal unit 202 performs a scan at each predetermined scan timing and determines whether or not an advertising packet is received (step S101). When the advertising packet is not received (step S101: NO), the proximity detection unit 225 determines that the specific operator is not present in the vicinity, rewrites proximity data indicating the proximity state of the specific operator stored in the state storage unit 227 to blank (step S102) and waits until the next scan timing.

On the other hand, when the advertising packet is received (step S101: YES), the BLE communication unit 221 reads the device ID and the operator ID from the advertising packet. The proximity detection unit 225 determines whether or not the advertising packet in which the device ID indicates the work machine 100 is present (step S103). When the advertising packet in which the device ID indicates the work machine 100 is not present (step S103: NO), the proximity detection unit 225 determines that the specific operator is not present in the vicinity, rewrites the proximity data indicating the proximity state of the specific operator stored in the state storage unit 227 to blank (step S102) and waits until the next scan timing.

When the advertising packet in which the device ID indicates the work machine 100 is present (step S103: YES), the proximity detection unit 225 determines whether or not the right flag, which is associated with the operator ID of the advertising packet, in the operator storage unit 224 is ON (step S104). When the right flag associated with the operator ID is OFF (step S104: NO), the proximity detection unit 225 determines that the specific operator is not present in the vicinity, rewrites the proximity data indicating the proximity state of the specific operator stored in the state storage unit 227 to blank (step S102), and waits until the next scan timing.

When the right flag associated with the operator ID is ON (step S104: YES), the proximity detection unit 225 determines that the specific operator is present in the vicinity and updates the proximity data indicating the proximity state of the specific operator stored in the state storage unit 227, to the operator ID included in the advertising packet (step S105).

Next, the start-up unit 226 transmits a start-up signal to the gateway function controller 203 (step S106). As a result, the starter signal unit 202 can start the start-up of the gateway function controller 203 before the specific operator boards the work machine 100. In addition, the start-up unit 226 turns on an illumination (not shown) of the work machine 100 (step S107). As a result, the starter signal unit 202 can notify the specific operator of the position of the work machine 100 to be boarded.

Incidentally, in another embodiment, part of the above-described processing may not be performed. For example, the starter signal unit 202 according to another embodiment may not perform the processing of the steps S102, S103, and S105, and the step S107.

Figure 7:
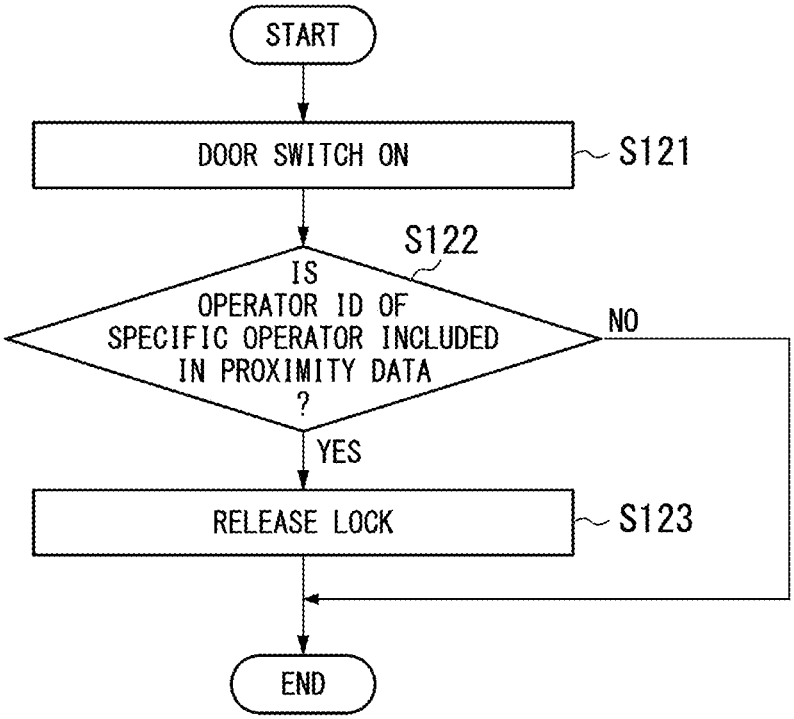
FIG. 7 is a flowchart showing an operation of the control system when a door switch is pressed in the first embodiment.

FIG. 7 is a flowchart showing an operation of the control system 145 when the door switch 1412 is pressed in the first embodiment.

When the door switch 1412 is pressed, the signal input unit 223 of the starter signal unit 202 receives the input of a signal indicating ON from the door switch 1412 (step S121). The proximity detection unit 225 refers to the proximity data of the state storage unit 227 and determines whether or not the operator ID of at least one specific operator is included (step S122). When the operator ID of the specific operator is included in the proximity data (step S122: YES), the proximity detection unit 225 determines that the specific operator is present in the vicinity, and the start-up unit 226 drives the lock actuator 1411 to release the lock of the door 141 (step S123). At this time, the start-up unit 226 may sound a buzzer indicating that the lock is released from a speaker (not shown).

On the other hand, when the operator ID of the specific operator is not included in the proximity data (step S122: NO), the proximity detection unit 225 determines that the specific operator is not present in the vicinity, and the start-up unit 226 does not drive the lock actuator 1411.

In this manner, the control system 145 releases the lock of the door 141 when the specific operator is present in the vicinity of the work machine 100 and does not release the lock when the specific operator is not present in the vicinity of the work machine 100.

Incidentally, the work machine 100 according to another embodiment may perform the lock release by a physical key regardless of the flowchart of FIG. 7.

Figure 8:
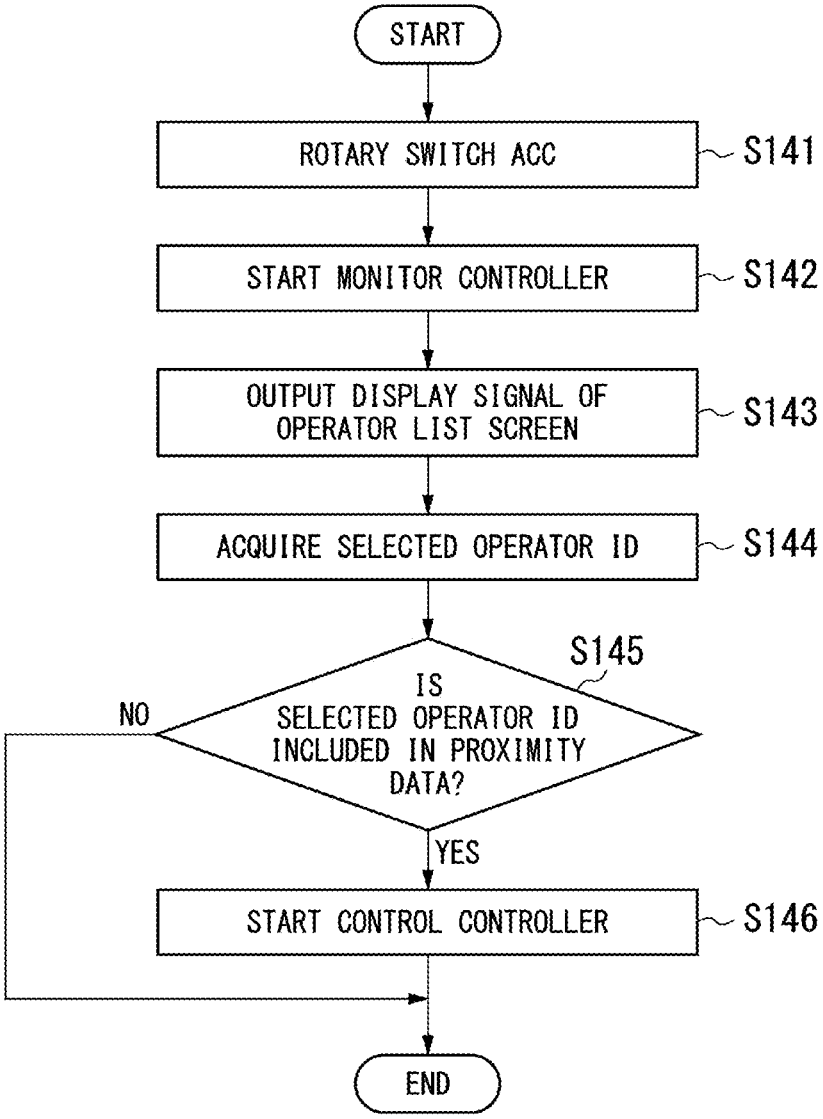
FIG. 8 is a flowchart showing an authentication operation of an operator who boards the work machine by the control system according to the first embodiment.

FIG. 8 is a flowchart showing an authentication operation of an operator who boards the work machine 100 by the control system 145 according to the first embodiment.

When the operator who boards the work machine 100 turns the rotary switch 144 to the ACC position, the signal input unit 223 of the starter signal unit 202 receives the input of a signal indicating ACC from the rotary switch 144 (step S141). When the signal indicating ACC is inputted, the start-up unit 226 transmits a start-up signal to the monitor controller 204 (step S142).

The monitor controller 204 outputs a signal to display an operator list screen to receive the selection of the operator ID to the touch panel 145D (step S143). The information indicating the operator list to receive the selection of the operator ID may be stored in the starter signal unit 202, may be stored in the gateway function controller 203, may be stored in the monitor controller 204, or may be stored in another controller. In addition, the monitor controller 204 may receive the information indicating the operator list from the control device external to the work machine 100 and may output a signal to display the operator list screen to the touch panel 145D. Incidentally, since the gateway function controller 203 is started in advance by the processing shown in FIG. 6, the monitor controller 204 can communicate with another controller immediately after the start-up. Therefore, when the monitor controller 204 acquires a signal to display the operator list screen from another controller, the monitor controller 204 can acquire the signal immediately after the start-up. A plurality of operator IDs read in the step S143 are included in the operator list screen. As a result, the touch panel 145D receives one selection from the plurality of operators.

When the operator selects one operator ID by operating the touch panel 145D, the control system 145 acquires the selected operator ID (step S144). The control system 145 determines whether or not the selected operator ID is included in the proximity data stored in the state storage unit 227 (step S145). When the selected operator ID is included in the proximity data (step S145: YES), the control system 145 authenticates that the operator on board is the specific operator. The start-up unit 226 transmits a start-up signal to the control controller 205 (step S146).

On the other hand, when the selected operator ID is not included in the proximity data (step S145: NO), the control system 145 determines that the authentication of the operator on board has failed. At this time, the start-up unit 226 does not transmit a start-up signal to the control controller 205. That is, even when the gateway function controller 203 is started due to the proximity of the specific operator and the lock of the door 141 is released, the control controller 205 to drive the work machine 100 by power is not started unless the operator on board is authenticated as the specific operator. As a result, the control system 145 can prevent the work machine 100 from being operated by an outsider who does not have the operation right.

As described above, the control system 145 performs authentication by having one operator ID selected from the plurality of operator IDs. When the operator on board is the specific operator who possesses the operator terminal 300, the operator can find and press the operator's own operator ID from the operator list screen. On the other hand, since an outsider who does not have the operation right does not know which operator ID indicates the specific operator present in the vicinity, the control system 145 can prevent an improper log-in.

At this time, the control system 145 may further enhance the security by further requesting a password or the like. In addition, in another embodiment, the operator may be authenticated using a biometrics authentication device, a face authentication device, or the like instead of the touch panel 145D. In addition, in another embodiment, the operator terminal 300 may be connected to the control system 145 to acquire the operator ID from the operator terminal 300 and perform the authentication of the operator.

The processing of the step S144 and the step S145 described above may be performed by the starter signal unit 202, may be performed by the gateway function controller 203, may be performed by the monitor controller 204, or may be performed by another controller. For example, the controller that performs the authentication acquires the selected operator ID and the proximity data stored in the state storage unit 227 and can determine whether or not the selected operator ID is included in the proximity data stored in the state storage unit 227.

Thereafter, when the rotary switch 144 is turned to the TG position, the start-up unit 226 transmits a start-up signal to the engine controller 206, and when the rotary switch 144 is turned to the ST position, the start-up unit 226 drives the cell motor 1211 to drive the engine 121. However, even when the engine 121 is driven, the work machine 100 cannot be driven by the power of the engine 121 unless the operator is authenticated and the control controller 205 is started. In addition, when the cell motor 1211 has a starter cut relay, the start-up unit 226 may set a starter cut output to be ON when the operator is authenticated, so that the engine 121 may not be driveable unless the operator is authenticated.

«Effects»

In this manner, according to the first embodiment, when it is detected that the specific operator is in close proximity to the work machine 100, the control system 145 starts the gateway function controller 203 before the control controller 205. In this manner, the control system 145 can cause the work machine 100 to be operated at an early stage by starting the gateway function controller 203 due to the detection of the specific operator. Further, the control system 145 can enhance the security by starting the control controller 205 after the start-up of the gateway function controller 203. Since the control controller 205 is not started, the control controller 205 can be prevented from being cracked.

In particular, since the start-up time of the gateway function controller 203 according to the first embodiment is longer than the start-up time of the control controller 205, a time for waiting for the start-up of the gateway function controller 203 can be omitted by starting the gateway function controller 203 first.

The control system 145 according to the first embodiment detects that the specific operator is in close proximity to the work machine 100 by detecting a wireless signal issued by the operator terminal 300 that the specific operator possesses. As a result, the operator can start the gateway function controller 203 of the work machine 100 only by approaching the work machine 100 while the operator terminal 300 is possessed.

In the first embodiment, the wireless signal issued by the operator terminal 300 includes a machine ID indicating the work machine 100 to be started, and the proximity detection unit 225 determines whether or not to start the gateway function controller 203 based on the machine ID included in the wireless signal. As a result, the control system 145 can prevent the work machine 100 not to be started from being unnecessarily started.

After detection is made that the specific operator is in close proximity to the work machine 100, the control system 145 performs the authentication of the operator by using the touch panel 145D provided in the cab 140 of the work machine 100. As a result, the control system 145 can start the control controller 205 after confirming that not only simply the specific operator is present in the vicinity of the work machine 100 but also the operator boarding the work machine 100 is the specific operator.

Another Embodiment

The embodiment have been described above in detail with reference to the drawings; however, the specific configurations are not limited to the above-described configurations, and various design changes or the like can be made. That is, in another embodiment, the order of the above-described processing may be appropriately changed. In addition, some of the processing may be executed in parallel.

The starter signal unit 202 according to the above-described embodiment may be configured by a single computer or may be configured such that the configurations of the starter signal unit 202 are divided and disposed in a plurality of computers and the plurality of computers cooperate with each other to function as the starter signal unit 202. For example, in the starter signal unit 202, the function of outputting the start-up signal and the function of performing the authentication of the operator may be implemented in a separate computer. A portion of the computers configuring the starter signal unit 202 may be mounted inside the work machine 100 and other computers may be provided outside the work machine 100.

In the control system 145 according to the above-described embodiment, a portion of the configurations constituting the control system 145 may be mounted inside the work machine 100, and other configurations may be provided outside the work machine 100.

The operator terminal 300 according to the above-described embodiment is a terminal that can execute an application program of such as a smartphone, but is not limited thereto. For example, the operator terminal 300 according to another embodiment may be a key fob having only a function of outputting a predetermined advertising packet. Incidentally, when the operator terminal 300 is a key fob, the selection of the work machine 100 to be started cannot be received by the application program. In this case, among the work machines 100 that receive the advertising packet, all in which the operator ID included in the advertising packet is set as the specific operator may be started.

The control system 145 according to the above-described embodiment displays the operator list screen including the plurality of operator IDs but is not limited thereto. For example, the control system 145 according to another embodiment may display only the operator ID corresponding to the specific operator determined to be in close proximity to the work machine 100 by the proximity detection unit 225 on the operator list screen. In this case, when one specific operator is determined to be in close proximity, one operator determined to be in close proximity can be displayed on the operator list screen, and when two or more specific operators are determined to be in close proximity, two or more operators determined to be in close proximity can be displayed on the operator list screen.

The starter signal unit 202 according to the above-described embodiment starts the gateway function controller 203 by the proximity of the specific operator but is not limited thereto. For example, the starter signal unit 202 according to another embodiment may start another controller (the monitor controller 204, a camera controller (not shown), or the like) other than the control controller 205, in place of or in addition to the gateway function controller 203.

The gateway function controller 203, the monitor controller 204, the control controller 205, and the engine controller 206 according to the above-described embodiment constitute a control unit that controls the work machine 100, but the present invention is not limited thereto. For example, in another embodiment, the control unit that controls the work machine 100 may be configured by part of the gateway function controller 203, the monitor controller 204, the control controller 205, and the engine controller 206. In addition, for example, in another embodiment, the control unit may further include another controller.

The work machine 100 according to the above-described embodiment is a hydraulic excavator but may be another work machine in another embodiment. Exemplary examples of the work machine 100 include a bulldozer, a dump truck, a forklift, a wheel loader, a motor grader, or the like.

<Computer Configuration>

Figure 9:
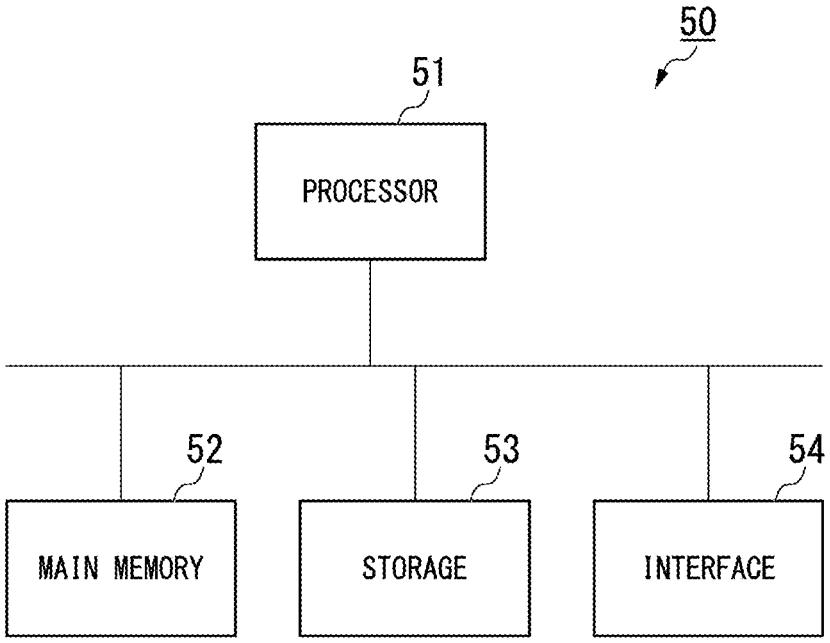
FIG. 9 is a schematic block diagram showing a configuration of a computer according to at least one embodiment.

FIG. 9 is a schematic block diagram showing a configuration of a computer according to at least one of the embodiments.

Each device (the starter signal unit 202, the gateway function controller 203, the monitor controller 204, the control controller 205, the engine controller 206, or the like) included in the control system 145 described above is implemented on a computer 50. The computer 50 includes a processor 51, a main memory 52, a storage 53, and an interface 54. The operation of each processing portion described above is stored in the storage 53 in the form of a program. The processor 51 reads the program from the storage 53, develops the program in the main memory 52, and executes the processing according to the program. In addition, the processor 51 secures a storage area corresponding to each of the storage units described above in the main memory 52 in accordance with the program. Exemplary examples of the processor 51 include a central processing unit (CPU), a graphic processing unit (GPU), a microprocessor, or the like.

The program may be for realization of some of the functions that the computer 50 is caused to exhibit. For example, the program may function in combination with another program stored in the storage in advance or in combination with another program installed in another device. Incidentally, in another embodiment, the computer 50 may include a custom large scale integrated circuit (LSI) such as a programmable logic device (PLD), in addition to the above configuration or instead of the above configuration. Exemplary examples of the PLD include a programmable array logic (PAL), a generic array logic (GAL), a complex programmable logic device (CPLD), and a field programmable gate array (FPGA). In this case, part or all of the functions realized by the processor 51 may be realized by the integrated circuit. Such an integrated circuit is also included as an example of the processor.

Exemplary examples of the storage 53 include a magnetic disk, a magneto-optical disk, an optical disk, a semiconductor memory, or the like. The storage 53 may be an internal medium directly connected to a bus of the computer 50 and may be an external medium connected to the computer 50 via the interface 54 or a communication line. In addition, when this program is delivered to the computer 50 through a communication line, the computer 50 receiving the delivered program may develop the program in the main memory 52 and execute the above processing. In at least one embodiment, the storage 53 is a non-transitory tangible storage medium.

In addition, the program may be for realizing some of the above-described functions. Further, the program may be a so-called differential file (differential program) that realizes the above-described function in combination with other programs already stored in the storage 53.

INDUSTRIAL APPLICABILITY

According to the above aspects, the work machine start-up system can enable the work machine to be operated at an early stage.

REFERENCE SIGNS LIST

100: Work machine
110: Undercarriage
120: Swing body
121: Engine
1211: Cell motor
130: Work equipment
140: Cab
1411: Lock actuator
1412: Door switch
142: Driver seat
143: Operation device
144: Rotary switch
145: Control system
145D: Touch panel
201: Power supply portion
202: Starter signal unit
203: Gateway function controller
204: Monitor controller
205: Control controller
206: Engine controller
221: BLE communication unit
222: Network communication unit
223: Signal input unit
224: Operator storage unit
225: Proximity detection unit
226: Start-up unit
227: State storage unit
300: Operator terminal

The invention claimed is:

1. A work machine start-up system comprising:

a computer including a processor that executes a processing according to a program, wherein the computer includes:

a first controller configured to output a control signal to drive a vehicle body with power supplied by a power source;

a second controller configured to control communication between controllers; and a third controller configured to perform communication with a terminal owned by an operator of the work machine, and the third controller is configured to:

determine whether or not the terminal is present in close proximity to the work machine, and start the second controller in a case in which it is determined that the terminal is present in close proximity to the work machine, and start the first controller after starting the second controller.

2. The work machine start-up system according to claim 1, wherein a start-up time of the first controller is shorter than a start-up time of the second controller.

3. The work machine start-up system according to claim 2, further comprising:

an authenticator provided in a cab of the work machine and configured to authenticate an operator present in the cab, wherein the computer is configured to start the first controller in a case in which it is authenticated that the operator who owns the terminal is a specific operator who has an operation right for the work machine after determining whether or not the terminal is present in close proximity to the work machine.

4. The work machine start-up system according to claim 3, wherein the third controller is configured to determine whether or not the terminal is present in close proximity to the work machine by detecting a wireless signal issued from the terminal.

5. The work machine start-up system according to claim 2, wherein the third controller is configured to determine whether or not the terminal is present in close proximity to the work machine by detecting a wireless signal issued from the terminal.

6. The work machine start-up system according to claim 5, wherein the wireless signal issued by the terminal includes a machine ID indicating a work machine to be started, and wherein the third controller is configured to determine whether or not to start the second controller based on the machine ID included in the wireless signal.

7. The work machine start-up system according to claim 1, further comprising:

an authenticator provided in a cab of the work machine and configured to authenticate an operator present in the cab, wherein the computer is configured to start the first controller in a case in which it is authenticated that the operator who owns the terminal is a specific operator who has an operation right for the work machine after determining whether or not the terminal is present in close proximity to the work machine.

8. The work machine start-up system according to claim 7, wherein the third controller is configured to determine whether or not the terminal is present in close proximity to the work machine by detecting a wireless signal issued from the terminal.

9. The work machine start-up system according to claim 8, wherein the wireless signal issued by the terminal includes a machine ID indicating a work machine to be started, and wherein the third controller is configured to determine whether or not to start the second controller based on the machine ID included in the wireless signal.

10. The work machine start-up system according to claim 1, wherein the third controller is configured to determine that the terminal is present in close proximity to the work machine by detecting a wireless signal issued from the terminal.

11. The work machine start-up system according to claim 10, wherein the wireless signal issued by the terminal includes an operator ID indicating an operator, and wherein the third controller is configured to determine whether or not the person is present in close proximity to the work machine based on the operator ID included in the wireless signal.

12. The work machine start-up system according to claim 11, wherein the wireless signal issued by the terminal includes a machine ID indicating a work machine to be started, and wherein the third controller is configured to determine whether or not to start the second controller based on the machine ID included in the wireless signal.

13. The work machine start-up system according to claim 10, wherein the wireless signal issued by the terminal includes a machine ID indicating a work machine to be started, and wherein the third controller is configured to determine whether or not to start the second controller based on the machine ID included in the wireless signal.

14. The work machine start-up system according to claim 1, wherein the wireless signal issued by the terminal includes a machine ID indicating a work machine to be started, and wherein the third controller is configured to determine whether or not to start the second controller based on the machine ID included in the wireless signal.

15. A work machine start-up method comprising:

determining whether or not a terminal owned by an operator of the work machine is present in close proximity to the work machine; and starting a second controller configured to control communication between controllers in a case in which it is determined that the terminal is present in close proximity to the work machine, and starting a first controller configured to output a control signal to drive a vehicle body with power supplied by a power source after starting the second controller.

16. A work machine start-up system comprising:

a processor configured to:

control a work machine;

detect that a specific operator is in close proximity to the work machine;

start at least part of the control when it is detected that the specific operator is in close proximity to the work machine;

detect that the specific operator is in close proximity to the work machine by detecting a wireless signal issued from a terminal possessed by the specific operator, wherein the wireless signal issued by the terminal includes an operator ID indicating an operator;

determine whether or not a person who is in close proximity to the work machine is the specific operator based on the operator ID included in the wireless signal, wherein the wireless signal issued by the terminal includes a machine ID indicating a work machine to be started; and determine whether or not to start the second controller based on the machine ID included in the wireless signal.

* * * * *